United States Patent [19]

Sayles

[11] 3,939,018

[45] Feb. 17, 1976

[54] SOLID PROPELLANT CONTAINING ORGANIC PERCHLORATE SALT AS BURNING RATE ACCELERATOR

[75] Inventor: David C. Sayles, Huntsville, Ala.

[73] Assignee: The United States of America as represented by the Secretary of the Army, Washington, D.C.

[22] Filed: Sept. 20, 1968

[21] Appl. No.: 761,902

[52] U.S. Cl. ..... 149/19.1; 149/19.9; 149/20; 149/40; 149/75; 149/76

[51] Int. Cl.[2] ..... C06D 5/06

[58] Field of Search ..... 149/19, 20, 75, 76, 19.1, 149/40, 19.9

[56] References Cited

UNITED STATES PATENTS 3,346,589 10/1967 Grianni et al. ..... 149/19 X

*Primary Examiner*—Richard D. Lovering
*Assistant Examiner*—E. A. Miller
*Attorney, Agent, or Firm*—Nathan Edelberg; Robert P. Gibson; Jack W. Voigt

[57] ABSTRACT

The incorporation of tris(difluoroamino)-methoxyethyl ammonium perchlorate in small percentages in conventional composite solid propellant compositions to achieve a marked increase in burning rates.

4 Claims, No Drawings

SOLID PROPELLANT CONTAINING ORGANIC PERCHLORATE SALT AS BURNING RATE ACCELERATOR

DEDICATORY CLAUSE

The invention described herein may be manufactured, used, and licensed by or for the Government for governmental purposes without the payment to me of any royalties thereon.

BACKGROUND OF THE INVENTION

This invention relates to a novel burning rate accelerator for use in conventional composite solid propellant compositions.

Conventional composite solid propellant compositions are composed essentially of three main components; namely, a combustible organic resin as binder, fuel, and an oxidizing agent. In use, such propellant compositions are enclosed within a chamber and ignited whereby large quantities of gases are formed. These gases are exhausted through an orifice thereby giving propulsive force to the vehicle in the opposite direction.

The binder component of the propellant composition is typically one of a wide variety of resins, such as polyalcohols, carboxylated polybutadiene, hydroxylated polybutadiene, and polybutadiene acrylic acid cross-linked with an appropriate cross linking agent.

The oxidizing agent is usually an inorganic oxidizing salt, such as ammonium perchlorate. The acidic radical of the inorganic oxidizing salt can also be chlorate, nitrate or the equivalent.

The desirability of rapid burning propellant compositions for rocket and ordnance projections as well established.

Burning rate catalysts have long been used to achieve rapid burning propellant compositions. Examples of prior art burning rate catalysts are ferric oxide, copper chromite, ferrocene, normal-butylferrocene and a wide variety of other ferrocene compounds. However, by substituting one of these prior art burning rate catalysts for the conventional oxidizing material, oxidizer content of the propellant composition is sacrificed. Accordingly, a combination burning rate catalyst and oxidizing agent has long been sought after.

An object of this invention is to provide an improved solid propellant composition.

Another object of this invention is to provide a solid propellant composition with an increased burning rate.

A particular object of this invention is to provide a propellant composition having an increased burning rate by means of a combination burning rate catalyst and oxidizing agent.

SUMMARY OF THE INVENTION

Tris(difluoroamino)-methoxyethyl ammonium perchlorate may be incorporated in small percentages in conventional composite propellant compositions to achieve a marked increase in the burning rates thereof.

DESCRIPTION OF THE PREFERRED EMBODIMENT

Tris(difluoroamino)-methoxyethyl ammonium perchlorate, $(F_2N)_3C.O.CH_2.CH_2NH_3^+ClO_4^-$, may be incorporated in small percentages in conventional composite propellant compositions to achieve a marked increase in the burning rates thereof. It is substituted for part of the ammonium perchlorate or other conventional oxidizing agent of the prior art propellant composition and functions as a combination burning rate catalyst and oxidizing agent. The propellant compositions of this invention also contain a binder fuel, and, optionally, a powdered metal such as aluminum and various compounding ingredients commonly employed in making composite propellant compositions, such as plasticizers, oxidation inhibitors, wetting agents, modifiers, curing agents, other burning rate accelerators and catalysts, and the like. The propellant composition can be formed into a grain having any desired shape, configuration, or geometry, such as grains of the internal, and external burning types. These grains can be molded, cast, or extruded and can be restricted or inhibited with any suitable and well-known restricting material, such as asbestos filled synthetic rubbers.

The combination burning rate catalyst and oxidizer is an essential ingredient used in the propellant formulations disclosed herein as Composition "B" and Composition "C". The essential ingredient is a complex perchlorate salt as more specifically defined and illustrated by preparative procedures set forth below. The perchlorate salt of this invention helps to achieve the objects of this invention by contributing to the marked increase in burning rate. The use of this ingredient permits the formulation of widely varied propellant compositions when substituted for part of the conventional oxidizer of a composite propellant.

Tris(difluoroamino)-methoxyethyl ammonium perchlorate, $(NF_2)_3C.O.CH_2.CH_2.NH_3^+ClO_4^-$, is prepared by completing a series of reactions set forth after the identities (a) and (b) below.

(a) Guanidine, with formula:

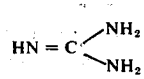

When fluorinated by standard procedure yields a compound with the formula:

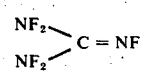

The compound named perfluoroguanidine (PFG) is used during step II reaction to follow.

(b) FC-75 — "Fluorochemical Liquid, Inert, FC-75", manufactured by Minnesota Mining and Mfg. Co., Chemical Div., 900 Bush Ave., St. Paul 6, Minnesota. A fully fluorinated product composed of a mixture of compounds containing eight carbon atoms, principally perfluoroethers, boiling point 210°–225° F. Refer to the Condensed Chemical Dictionary, Sixth Edition, Page 507, Reinhold Publishing Corporation for other properties of FC-75. The FC-75 is used as a heat transfer inert solvent for steps II & III reactions set forth below.

Step I

Ethanolamine (1.44 Moles) in absolute ethanol (3 liters) is titrated to a pH of 5.0 with 70% perchloric acid (30% water) at 0° C. Approximately 15 mole percent of urea (catalyst) is added and allowed to dissolve; then the ethanol-water is stripped off remotely. Moisture-free acetonitrile is added remotely to produce a 50% (by weight) of ethanolaminium perchlorate (EAP).

Step II

The EAP-acetonitrile solution is charged to a reactor containing 2.5 mls. of FC-75 per ml. of EAP solution; cooled to − 35° C and the air space in the reactor evacuated. A solution of perfluoroguanidine (PFG) (1.58 moles) in FC-75 (about 8 wt. % PFG) is added. The reaction is allowed to run 8–10 hours at 30°–40°C and pressure of 10–50 psig.

Step III

The reactor containing the reaction products is cooled to −35°C, and vented. A mixture of $N_2$ (80%) and $F_2$ (20%) (by volume) is fed to the reactor. The reactor "off gas" is passed through a sodium fluoride column (to remove HF) and a bubbler containing potassium iodide (KI) solution (to chemically reduce $F_2$ and nitrogen-fluorine vapors). FC-75 phase is separated, and the acetonitrile phase containing the perchlorate salt is separated, and the acetonitrile phase containing the perchlorate salt is diluted and extracted by standard laboratory procedure, preferably remotely. The product can be blended in the propellant compositions by conventional procedures during the mixing of the propellant ingredients as described in more detail later.

The following chemical equations represent the reactions accomplished in steps I, II, and III above.

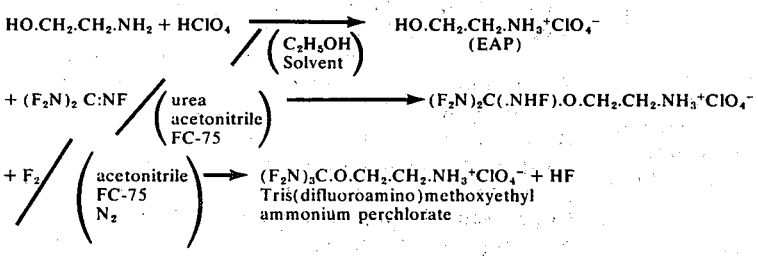

As mentioned previously, the solid propellant compositions of this invention can contain a powdered metal, for example, aluminum, boron, magnesium, beryllium, and the like. Alloys can also be used such as the aluminum alloys of boron, magnesium, and the like. Silicon can also be utilized and the term "metal" is used herein to include silicon. Generally the components of the solid propellant compositions of this invention are present in the following approximate relative amounts: tris(difluoroamino)-methoxyethyl ammonium perchlorate 1–15 weight percent; ammonium perchlorate = 50–70 weight percent; binder = 10–20 weight percent; and, powdered metal =1–18 weight percent. Obviously, the weight percentages of the components of the propellant composition must total 100 percent.

The following table compares a prior art propellant (Composition A) having a "standard" burning rate catalyst (n-butylferrocene) and oxidizer (ammonium perchlorate) with "Composition B" and "Composition C" of this invention.

A COMPARISON OF BURNING RATES OF PROPELLANTS CONTAINING TRIS(DIFLUOROAMINO)-METHOXYETHYL AMMONIUM PERCHLORATE AS A REPLACEMENT FOR NORMAL BUTYLFERROCENE

A COMPARISON OF BURNING RATES OF PROPELLANTS CONTAINING TRIS(DIFLUOROAMINO)METHOXYETHYL AMMONIUM PERCHLORATE AS A REPLACEMENT FOR NORMAL BUTYLFERROCENE

| Ingredient | Composition A | Composition B | Composition C |
|---|---|---|---|
| Ammonium Perchlorate (6-micron) | 68.0 | 62.6 | 65.1 |
| Aluminum (50-micron) | 14.0 | 14.0 | 14.0 |
| n-Butylferrocene | 7.0 | — | 3.5 |
| tris(difluoroamino)methoxyethyl ammonium perchlorate | — | 12.4 | 6.4 |
| Carboxyl-terminated polybutadiene prepolymer | 10.5 | 10.5 | 10.5 |
| Tris(methylaziridinyl)phosphine oxide, Tris(oxiranyl)-para-aminophenol, Iron linoleate, Lecithin | 0.5 | 0.5 | 0.5 |
| Burning rate (ips) (1000psi) | 1.3 | 1.9 | 2.3 |

The binder function for the propellants listed in the table is accomplished by the polybutadiene when cured. The binder function can also be accomplished by other binder systems used in conventional composite propellants. Such binder systems may include both hydrocarbon, resinous or polyurethane type binders which may be cured by crosslinking agents, isocyanates, epoxy compounds and the like.

A propellant composition of this invention must include both a small percentage of tris(difluoroamino)-methoxyethyl ammonium perchlorate and a large percentage of a conventional oxidizing agent such as ammonium perchlorate. If all of the conventional oxidizing agent is replaced by tris(difluoroamino)methoxyethyl ammonium perchlorate, the resulting propellant composition is too sensitive to shock or other type explosion, is too expensive and is too difficult to handle. Also, the tris(difluoroamino)-methoxyethyl ammonium perchlorate may only be incorporated in a conventional propellant composition and not in high energy propellant compositions, such as propellants containing nitrogen-fluorine functional groups. In the latter case, it is too unstable.

The tris(difluoroamino)-methoxyethyl ammonium perchlorate is added to the propellant formulation at the time the composite solid propellant composition is made. It may be introduced into the propellant formulation by incorporating it in the form of finely divided particles with the ammonium perchlorate before it is blended with the binder fuel, or by mixing it with the entire mass after the fuel and oxidizer are blended together.

I claim:

1. A composite solid propellant composition comprising up to 15 weight percent of tris(difluoroamino)-methoxyethyl ammonium perchlorate, an inorganic oxidizing agent, and an organic resin binder.

2. The propellant composition of claim 1 wherein said oxidizing agent is ammonium perchlorate.

3. The propellant composition of claim 2 wherein said weight percentage of tris(difluoroamino)-methoxyethyl ammonium perchlorate is from about 1 percent to about 15 percent, said weight percentage of oxidizing agent is from about 50 percent to about 70 percent, and the weight percentage of said binder is from about 10 to about 20 weight percent.

4. The propellant composition of claim 3 wherein said propellant composition additionally comprises a powdered metal having a weight percentage of from about 1 to about 18 percent.

* * * * *